US010823022B2

(12) United States Patent
Soatti et al.

(10) Patent No.: US 10,823,022 B2
(45) Date of Patent: Nov. 3, 2020

(54) MUFFLER FOR MOTOR VEHICLES

(71) Applicant: PIAGGIO & C. S.p.A., Pontedera, Pisa (IT)

(72) Inventors: Piero Soatti, Pisa (IT); Francesco Bellato, Pisa (IT)

(73) Assignee: PIAGGIO & C. S.P.A., Pontedera, Pisa (IT)

( * ) Notice: Subject to any disclaimer, the term of this patent is extended or adjusted under 35 U.S.C. 154(b) by 0 days.

(21) Appl. No.: 16/346,668

(22) PCT Filed: Nov. 3, 2017

(86) PCT No.: PCT/IB2017/056881
§ 371 (c)(1),
(2) Date: May 1, 2019

(87) PCT Pub. No.: WO2018/083650
PCT Pub. Date: May 11, 2018

(65) Prior Publication Data

US 2020/0056519 A1 Feb. 20, 2020

(30) Foreign Application Priority Data

Nov. 4, 2016 (IT) ..... 102016000110831

(51) Int. Cl.
*F01N 1/00* (2006.01)
*F01N 1/16* (2006.01)
(Continued)

(52) U.S. Cl.
CPC ..... *F01N 1/163* (2013.01); *F01N 1/08* (2013.01); *F01N 13/1838* (2013.01)

(58) Field of Classification Search
CPC . F01N 1/10; F01N 1/084; F01N 1/163; F01N 13/1838; F01N 1/083; F01N 1/16; F01N 1/08
(Continued)

(56) References Cited

U.S. PATENT DOCUMENTS 2,643,730 A 6/1953 Beattie
2006/0162995 A1* 7/2006 Schorn ..... F01N 1/083 181/237
(Continued)

FOREIGN PATENT DOCUMENTS

DE 94062005 U1 7/1994
EP 1686246 A2 8/2006
(Continued)

OTHER PUBLICATIONS

International Search Report for corresponding application PCT/IB2017/056881 filed Nov. 3, 2017; dated Mar. 12, 2018.
(Continued)

*Primary Examiner* — Jason D Shanske
(74) *Attorney, Agent, or Firm* — Cantor Colburn LLP

(57) ABSTRACT

A muffler (4) for motor vehicles comprising an intake pipe (8) of the exhaust gases that separates, at a fork (10), into a main pipe (12) and a secondary pipe (16), a muffler body (24) which delimits an expansion volume (28) and houses at least partly the main pipe (12) and the secondary pipe (16), wherein the intake pipe (8) of the exhaust gas is in fluid continuous connection with the main pipe (12) through the secondary pipe (16), and wherein the main pipe (12) comprises, downstream of the fork (10), a throttle valve (32) which allows or prevents a further fluidic connection of the intake pipe (8) of exhaust gas with the main pipe (12), and an output of the exhaust gases (40), for the expulsion of the gases from the muffler pipe (4).

14 Claims, 2 Drawing Sheets

(51) Int. Cl.
*F01N 1/08* (2006.01)
*F01N 13/18* (2010.01)

(58) Field of Classification Search
USPC ..... 60/324
See application file for complete search history.

(56) References Cited

U.S. PATENT DOCUMENTS

| | | | | |
|---|---|---|---|---|
| 2012/0273302 | A1* | 11/2012 | Takagaki | F01N 1/02 181/228 |
| 2016/0222848 | A1 | 8/2016 | Hayama | |
| 2016/0319946 | A1* | 11/2016 | Suhnel | F16K 11/0873 |
| 2016/0376953 | A1* | 12/2016 | Kruger | F01N 1/084 181/228 |
| 2017/0218806 | A1* | 8/2017 | LeRoy | G10K 11/161 |

FOREIGN PATENT DOCUMENTS

| | | |
|---|---|---|
| EP | 2412945 | 2/2012 |
| JP | 09228819 | 2/1996 |

OTHER PUBLICATIONS

Written Opinion for corresponding application PCT/IB2017/056881 filed Nov. 3, 2017; dated Mar. 12, 2018.

* cited by examiner

MUFFLER FOR MOTOR VEHICLES

FIELD OF APPLICATION

The present invention relates to a muffler for motor vehicles.

BACKGROUND ART

As is known, there are specific regulations in the field of motor vehicles which limit the noise caused by vehicles. These regulations are essentially aimed at limiting noise pollution especially in urban areas, or in conditions of gas choking.

Emissions limits imposed by certifications in fact refer to simulated conditions of daily use which do not involve the use of the engine at full power.

For this reason, muffler solutions are known that include movable valves or partitions that are operated according to the rotation speed of the engine in order to block or allow, at least partially, the passage of exhaust gases through pipes having appropriate sections prior to their expulsion to the atmosphere.

In particular, exhaust gases, before being expelled, pass through pipes that reduce noise emissions thereof by reflection (by suitably lengthening the path followed by the exhaust gases) and/or absorption (making the exhaust gases, on their way inside the muffler, touch sound-absorbing material, such as glass wool).

DISCLOSURE OF THE INVENTION

However, the prior art solutions have some drawbacks.

On the one hand, in fact, the need to reduce the noise emissions necessarily collides with the need to ensure the maximum power obtainable by the engine.

In fact, the restrictions imposed on exhaust gases tend to 'suffocate' the engine, thereby limiting the achievement of maximum power values.

On the other hand, silencing systems should be effective and efficient over time so as to ensure, for the lifetime of the device, the limitation of noise emissions. The movable mechanisms should therefore be efficient and effective throughout the life of the vehicle, so that i, for example, may pass any overhauling and/or check of the respective noise emissions.

Finally, the overall size of the muffler should be kept under control: the use of partitions, but also the provision of elongated paths for the exhaust gases, increase the total volume occupied by the muffler as well as the weight thereof. The overall dimensions and weights often have an essential role as design parameters and should be limited as much as possible, especially in some specific applications, such as in the motorcycle field.

The need of solving the drawbacks and overcoming the limitations mentioned with reference to the prior art is therefore felt.

In other words, the need is felt to provide a muffler that contains noise emissions without affecting the performance. A muffler able to ensure functional efficiency throughout the life of the vehicle, that is constructively conformed to increase as little as possible the dimensions and weights of the respective motor vehicle to which it is applied.

Such a need is met by a muffler according to claim 1.

DESCRIPTION OF THE DRAWINGS

Further features and advantages of the present invention will appear more clearly from the following description of preferred non-limiting embodiments thereof, in which.

Elements or parts of elements in common between the embodiments described below are referred to with the same reference numerals.

DETAILED DESCRIPTION

Figure 1:
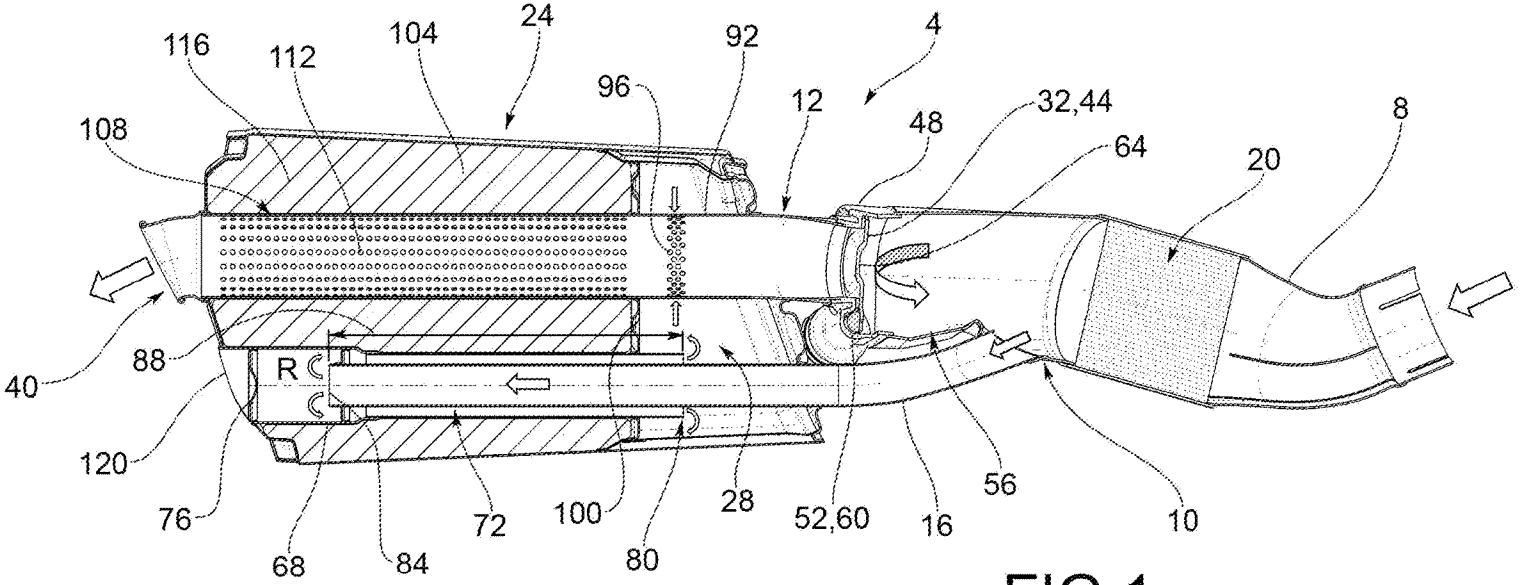
FIG. 1 is a sectional view of a muffler according to the present invention, in a chocked operating condition.

With reference to the above figures, reference numeral 4 globally indicates an overall schematic view of a muffler according to the present invention.

For the purposes of this invention, it should be noted that the term motor vehicle must be considered in a broad sense, encompassing any motor vehicle having at least two wheels, i.e. one front wheel and one rear wheel. Therefore, this definition also includes traditional motor vehicles having two wheels or having three wheels, such as two paired and steering wheels on the front end and one driving wheel at the rear, but also motorcycles that include only one wheel, steering, on the front end and two driving wheels at the rear. Finally, the definition of motor vehicle also includes the so-called city cars, cars and vehicles with three or more axles.

Muffler 4 for motor vehicles includes an intake pipe 8 of the exhaust gas which separates, at a relative fork 10, into a main pipe 12 and a secondary pipe 16.

The intake pipe 8 is typically connected to the exhaust manifolds of the engine, in a manner not shown.

According to a possible embodiment, the intake pipe 8 incorporates therein, upstream of the fork 10 between the main pipe 12 and the secondary pipe 16, a catalyst device 20 suitable for treating the exhaust gas freeing them at least partly of more polluting substances, such as Nox, HC and CO (in a known manner).

Muffler 4 includes a muffler body 24 which delimits an expansion volume 28 and houses at least partially the main pipe 12 and the secondary pipe 16.

The muffler body 24, as well as the pipe 12 and the secondary pipe 16, may be made of metallic material, preferably stainless steel, and/or titanium alloy to reduce the overall mass of muffler 4.

The intake pipe 8 is fluidically connected continuously, e.g. in every moment, with the main pipe 12 by means of the secondary pipe 16.

The main pipe 12 comprises, downstream of fork 10, a throttle valve 32 which allows or prevents direct access to the main pipe 12, in other words a direct and further fluidic connection of the intake pipe 8 with the main pipe 12. This direct fluidic connection is further or additional since the main pipe 12 is already fluidly connected with the intake pipe 8 by means of the secondary pipe 16.

The main pipe 12 comprises moreover an output of the exhaust gases 40, for the expulsion of the gases from the muffler pipe 4.

When the throttle valve 32 is opened, the intake pipe 8 is directly connected at the output of the exhaust gases 40 of the main pipe 12, thus increasing considerably the performances of the muffler 4.

The throttle valve 32 comprises a partition 44 that opens in the opposite direction to the flow of gas G coming from the intake pipe 8, and comprises a stop ledge 48 which realizes an undercut to the direction of the flow of gases G, in the closed configuration of partition 44 itself.

For example, the stop ledge 48 is achieved by a necking or bottleneck within the main pipe 12; in other words, said stop ledge has a circular crown configuration.

The fact that partition 44 opens in the opposite direction to the flow of gas G coming from the intake pipe 8, and the stop ledge 48 is arranged downstream of partition 44, with respect to the flow of exhaust gases improves the seal of the throttle valve 32 to the exhaust gases themselves. In fact, by impacting against the partition, the exhaust gases tend to tighten it further against the stop ledge 48, thus improving the seal thereof and preventing the considerable vibrations to which the throttle valve 32 is subjected from moving it, thereby creating gas leakage that would have direct access to the main pipe 12 (FIG. 1).

It has been verified that, in order to limit noise emissions, such leakage would result in a significant increase in the noise level.

For example, partition 44 is hinged at a hinge point 52 fixed to the main pipe 12.

Figure 2:
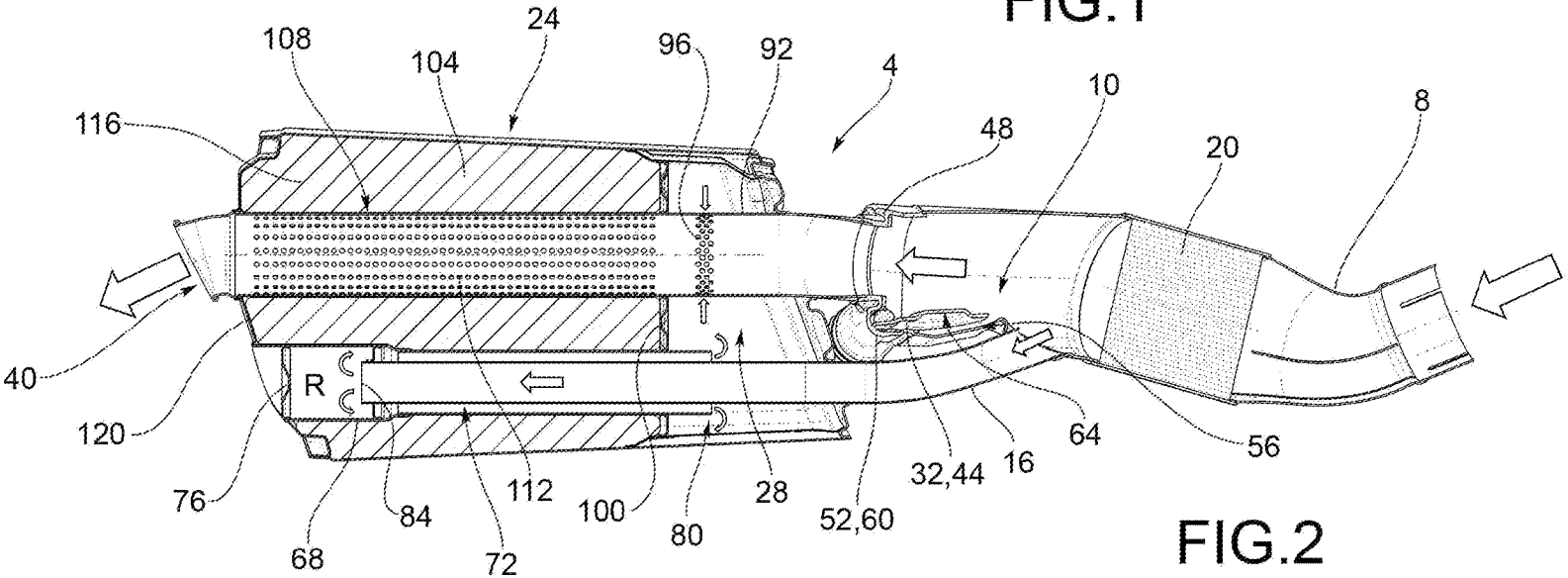
FIG. 2 is a sectional view of a muffler according to the present invention, in a non-chocked operating condition.

Preferably, the main pipe 12, at said partition 44, comprises a housing seat 56 of partition 44 in the open configuration of the latter. Preferably, the housing seat 56 is shaped so as to accommodate partition 44 so that the latter, in the open configuration, does not influence and does not restrict the flow of exhaust gases within the main pipe 12 (FIG. 2).

Partition 44 is operationally connected to motor means 60 for switching from the open configuration (FIG. 2) to the closed configuration (FIG. 1).

The opening law actuated by the motor means 60 may be changed as desired, as a function of the predetermined intervention threshold.

The opening/closing of the throttle valve 32 may also be modulated; in other words, the throttle valve 32 does not necessarily have two operating positions only, i.e. opening and closing, but intermediate positions between the opening and the closing ones may also be provided.

According to an embodiment, said partition 44 comprises a concavity 64 facing the exhaust gases coming from the intake pipe 8 of the exhaust gases.

Concavity 64 has the function of further improving the tightness of the valve to exhaust gases.

In fact, such a concavity 64 collects the exhaust gases that impact thereon and on the one hand this increases the thrust force of the gases that contribute to the closing of the valve itself, and on the other hand favors the redirection of the exhaust gases towards fork 10 and therefore towards the secondary pipe 16.

The volumetric flow mass of the exhaust gases which flows in the secondary pipe 16 increases when the throttle valve 32 is at least partially or completely closed.

At every operating positioning of the throttle valve 32, a minimum flow is ensured in the secondary pipe 16 so as to silence, at least partially, the exhaust gases.

The secondary pipe 16 is at least partially contained in a containment pipe 68 fitted around the secondary pipe 16 so as to delimit an interspace 72 therewith.

The containment pipe 68 has a closed bottom 76 and an opposite open end 80 connected with the expansion volume 28; in other words, the containment pipe has a glass shape.

The closed bottom 76 is arranged facing an exhaust opening 84 of the secondary pipe 16 so as to direct the exhaust gases leaving the secondary pipe 16 towards said open end 80, after a counter current path, through interspace 72, by distance 88 between the exhaust opening 84 of the secondary pipe 16 and the open end 80.

The open end 80 is in turn fluidically connected with the main pipe 12, as better described below.

The reversal of the exhaust gas motion is shown by arrows F, R in FIGS. 1-2.

In particular, the exhaust gases enter the secondary pipe 16 with a feeding direction F, moving towards the exhaust opening 84 and once at said exhaust opening 84, under the action of the barrier formed by the closed bottom 76 of the containment pipe 68, reverse the motion going back, according to a backward motion T towards the open end 80. In this backward motion, the exhaust gases do not flow through the secondary pipe 16 again, but through interspace 72 delimited between the secondary pipe 16 and the containment pipe 68.

The containment tube 68 is for example arranged coaxially to the secondary pipe 16, so as to delimit with the secondary pipe 68 interspace 72 flowing into the open end 80.

The open end 80 for example has a circular crown cross-section, with respect to a plane having a cross-section perpendicular to a main longitudinal direction of the secondary pipe 16 itself, said circular crown cross-section being defined between the outer containment tube 68 and the inner secondary pipe 16.

Preferably, the containment tube 68 is fitted around the secondary pipe 16 for a portion equal to at least 30% of the length of the secondary pipe 16.

By length of the secondary pipe 16 it is meant the distance between fork 10 and said exhaust opening 84.

Preferably, interspace 72 has a gas passage section not smaller than, that is, greater than or equal to, the passage section of the secondary pipe 16. The passage sections are measured perpendicular to a prevailing longitudinal direction of the secondary pipe 16 itself.

Preferably, the main pipe 12 and the secondary pipe 16 have different through cross-sections for the exhaust gases.

For example, the secondary pipe 16 has a through cross-section between 20% and 50% of the through cross-section of the main pipe 12.

As seen, the open end 80 is fluidically connected with the main pipe 12.

In particular, the main pipe 12, at a first portion 92 contained in the expansion volume 28, comprises a plurality of inlet holes 96 suitable to allow the leakage into it of the exhaust gases expanded in the expansion volume 28, coming from the open end 80 of the secondary pipe 16.

Such inlet holes 96 pass through the side wall of the first portion 92 of the main pipe 12 to allow the inlet of the exhaust gases in the main pipe according to a radial direction X.

According to an embodiment, the muffler body 24 comprises a separator septum 100 which divides it into the expansion volume 28 containing the open end 80, the initial portion 92 and the input holes 96, so as to allow the conveying of the exhaust gases coming from the open end 80 into the inlet holes 96, and a second portion 104 which houses an end portion 108 of the main pipe 12 which ends with the output of the exhaust gases 40.

According to a possible embodiment, the separator septum 100 supports at least partially the containment pipe 68 and/or the secondary pipe 16.

For example, the containment pipe 68 may be supported by the separator septum 100, on the open end 80 side, and by a bottom wall 120 of the muffler body 24, on the side of the exhaust opening 84. The bottom wall 120 of the muffler body 24 in turn supports the main pipe 12 and in particular the output of the exhaust gases 40. The second portion 104 comprises damping holes 112 surrounded by sound absorbent material 116 fitted around the end portion 108 of the main pipe 12.

As sound-absorbing material 116, for example, glass wool and similar materials known in the art may be used.

The operation and thus the regulation of a muffler for motor vehicles according to the present invention shall now be described.

In particular, in chocked configuration (FIG. 1), i.e. of closed throttle valve 32, the exhaust gases from the intake pipe 8 cannot directly flow through the main pipe 12 since they encounter in their path the barrier formed by the throttle valve 32.

Due to the fact that such a throttle valve 32 opens in counter current and therefore in the closed position, it abuts against an undercut realized by the stop ledge 48 arranged behind the exhaust gas flow. The latter, by impacting against the throttle valve 32 itself in the closed condition, increase the tightness thereof, pushing it further in closing and avoiding possible openings thereof due to vibration of muffler 4.

Therefore, the gases flow through the secondary pipe 16, exit from the exhaust opening 84 where they encounter the closed bottom 76 of the containment pipe 68 which prevents gases from dispersing directly within the expansion volume 28, if not before flowing through a specific path. The exhaust gases, in fact, must flow on a reverse path with respect to that within the secondary pipe 16 to exit at the open end 80, on the opposite side of the closed bottom 76. From the open end 80, the gases can expand to then enter the main pipe 12 through the inlet holes 96.

Once entered into the main pipe 12, the exhaust gases can flow therein entirely before being expelled outside muffler 4, through the output of the exhaust gases 40. Of course, the forced passage of the exhaust gases through the secondary pipe 16 and their reversal of motion due to the fitting of the containment pipe 68 first determines a considerable extension of the path of the exhaust gases with respect to the path through the main pipe 12. This extension allows greater dissipation of noise as the reflection of the exhaust gases increases before passing the second portion 104 filled with the sound-absorbing material 116.

Of course, such a configuration also produces some occlusion to the exhaust gases and thus a limitation of the power obtainable: such a configuration is combined with a chocked operation of the engine, i.e. when maximum power is not required.

In non-chocked configuration (FIG. 2), the throttle valve 32 is open and thus allows the exhaust gases coming from the intake pipe 8 to enter directly into the main pipe 12, without forcibly passing through the secondary pipe 16.

It is clear that the exhaust gases, by encountering less resistance through the main pipe 12, will tend to enter directly the latter and not to enter the secondary pipe 16. Moreover, as there is no real occlusion of the secondary pipe 16, a portion of the exhaust gases may flow through it and then enter the main pipe 12 through the inlet holes 96 as already described in connection with the operation in the chocked configuration. The exhaust gases flowing through the main pipe 12 are in turn silenced at least partially through the use of sound-absorbing material 116 surrounding the main pipe 12.

Figure 4:
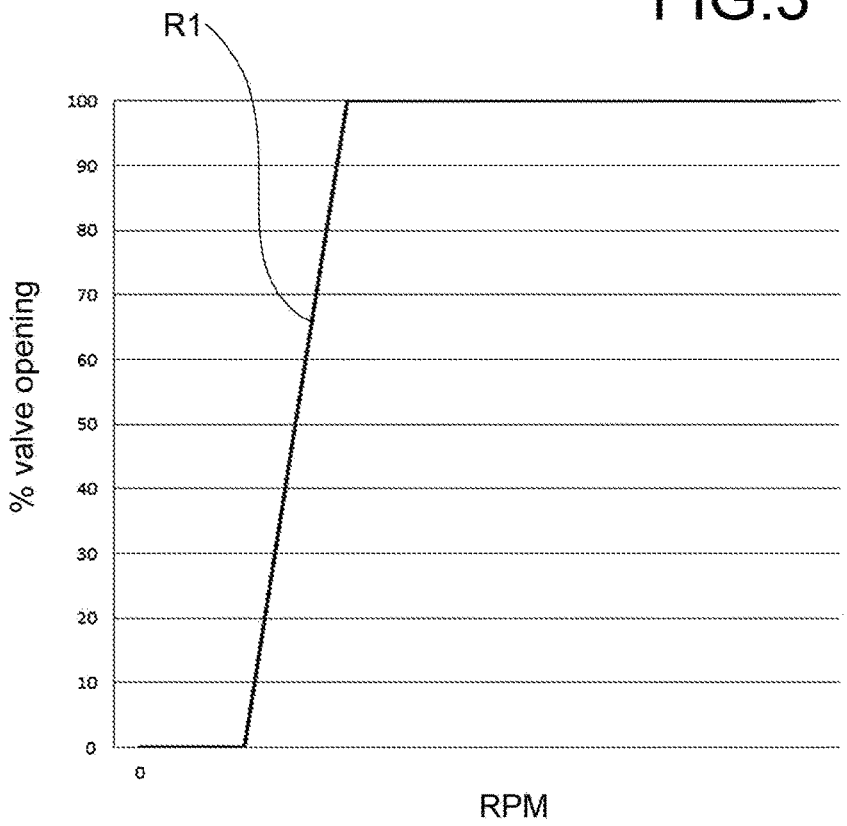
FIG. 4 is a diagram of a possible actuating law of a throttle valve of the muffler according to the present invention.

FIG. 4 shows a possible opening/closing law of the throttle valve 32. As can be seen, such a law is for example linear and provides a very sharp ramp R1; different actuating laws may also be implemented, both linear and non-linear, in order to control the opening/closing of the throttle valve 32.

Figure 3:
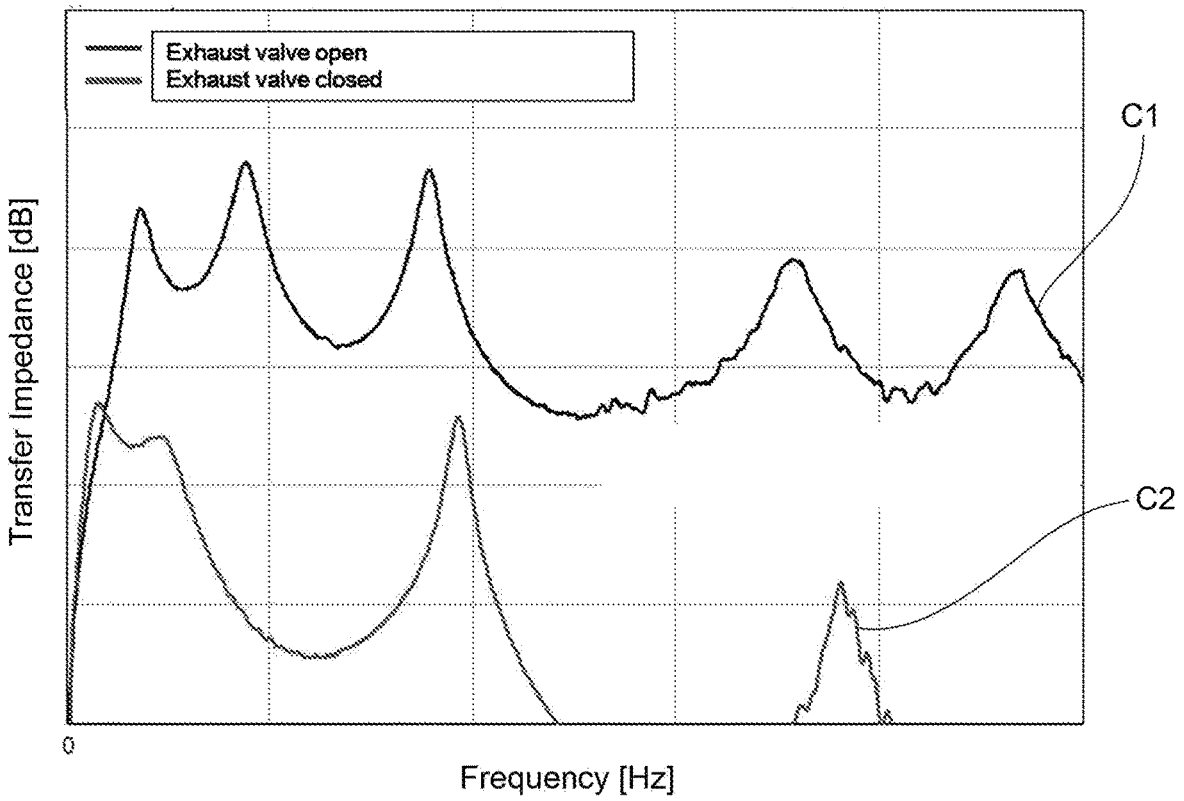
FIG. 3 is a diagram of the sound emissions of a muffler according to the present invention, as a function of frequency, in the two chocked and non-chocked operating conditions.

FIG. 3 shows a chart comparing the noise emissions of a muffler according to the present invention, both in throttle valve open configuration, curve C1, and in valve closed configuration, curve C2, as the frequency of excitation varies (which is in turn proportional to the rotational speed of the engine). As can be seen, curves C1, C2 have a similar trend but chart C1, in configuration of valve 32 open, which corresponds to the maximum power obtainable by the engine, shows noise levels much higher than those obtainable in configuration of valve 32 closed (curve C2).

The graphs in FIG. 3 demonstrate the remarkable effectiveness of the muffler according to the present invention, in terms of reduction of noise emissions at the exhaust.

Of course, the intervention threshold of the throttle valve may be changed as desired and partial opening/closing configurations of valve 32 may also be used.

As can be appreciated from the description, the present invention allows overcoming the drawbacks of the prior art.

In particular, the suspension muffler significantly reduces noise emissions when working in chocked or closed configuration.

In such a configuration, in fact, the exhaust gases are forced to pass through a significantly longer path, due to a reversal of the feeding motion, in order to significantly reduce the noise output.

In this configuration, the throttle valve ensures gas-tightness, due to the fact that it opens upstream, i.e. in the opposite direction to the flow of gases: in this way, the exhaust gases with their pressure help to tighten the valve closed, also avoiding possible leaks due to the significant vibrations to which it is subjected. This ensures the gas tightness over time, also due to the inevitable clearances that, due to wear and vibrations, the valve may take. In other words, the thrust of the exhaust gases will always tend to cancel such clearances, ensuring a long term seal thereof.

In the open or not choked configuration, the gases can freely pass through the main pipe, so as o allow the achievement of full power, after silencing through the devices along said main pipe.

A man skilled in the art may make several changes and adjustments to the mufflers described above in order to meet specific and incidental needs, all falling within the scope of protection defined in the following claims.

An embodiment particularly advantageous is hereby described:

Muffler (4) for motor vehicles comprising:

an intake pipe (8) of the exhaust gas which separates, at a fork (10), into a main pipe (12) and a secondary pipe (16), a muffler body (24) which delimits an expansion volume (28) and houses at least partially the main pipe (12) and the secondary pipe (16), wherein the main pipe (12) comprises, downstream of the fork (10), a throttle valve (32) which allows or prevents direct access to the main pipe (12), and an output of the exhaust gases (40), for the expulsion of the gases from the muffler pipe (4), wherein the secondary pipe (16) is at least partially contained in a containment tube (68) fitted around the secondary pipe (16) so as to delimit therewith an interspace (72), the containment tube (68) having a closed bottom (76) and an opposite open end (80) fluidically connected with the expansion volume (28), the closed bottom (76) being arranged facing an exhaust opening (84) of the secondary pipe (16) so as to convey the exhaust gases in output from said exhaust opening (84) of the secondary pipe (16) towards said open end (80), prior to a counter current path, in a portion of said interspace (72) defined between the exhaust opening (84) of the secondary pipe (16) and the open end (80), the open end (80) being fluidically connected with the main pipe (12).

The invention claimed is:

1. Muffler for motor vehicles comprising:

an intake pipe of exhaust gas which separates, at a fork, into a main pipe and a secondary pipe, a muffler body which delimits an expansion volume and houses at least partially the main pipe and the secondary pipe, wherein the intake pipe of the exhaust gas is in fluid continuous connection with the main pipe through the secondary pipe, and wherein the main pipe comprises, downstream of the fork, a throttle valve which allows or prevents a further fluidic connection of the intake pipe of exhaust gas with the main pipe, and an output of the exhaust gases, for the expulsion of the gases from the muffler;

wherein the main pipe, at a first portion contained in the expansion volume, comprises a plurality of inlet holes suitable to allow leakage into the main pipe of the exhaust gases expanded in the expansion volume, coming from an open end of the secondary pipe;

wherein the muffler body comprises a separator septum which divides the muffler body into the expansion volume and a second portion which ends with the output of the exhaust gases; and wherein an end portion of the main pipe housed in said second portion comprises damping holes surrounded by sound absorbent material fitted around the end portion of the main pipe.

2. Muffler for motor vehicles according to claim 1, wherein the secondary pipe is at least partially contained in a containment tube fitted around the secondary pipe so as to delimit therewith an interspace, the containment tube having a closed bottom and an opposite open end fluidically connected with the expansion volume, the closed bottom being arranged facing an exhaust opening of the secondary pipe so as to convey the exhaust gases output from said exhaust opening of the secondary pipe towards said open end, prior to a counter current path, in a portion of said interspace defined between the exhaust opening of the secondary pipe and the open end, the open end being fluidically connected with the main pipe.

3. Muffler for motor vehicles according to claim 2, wherein the containment tube is arranged coaxially to the secondary pipe, so as to delimit with the secondary pipe the interspace flowing into the open end.

4. Muffler for motor vehicles according to claim 2, wherein the open end of the containment tube has a circular crown cross-section, with respect to a plane having a cross-section perpendicular to a main longitudinal direction of the secondary pipe, said circular crown cross-section being defined between the containment tube and the secondary pipe.

5. Muffler for motor vehicles according to claim 1, wherein the main pipe and the secondary pipe have different through cross-sections for the exhaust gases.

6. Muffler for motor vehicles according to claim 1, wherein the secondary pipe has a through cross-section between 20% and 50% of a through cross-section of the main pipe.

7. Muffler for motor vehicles according to claim 2, wherein the containment tube is fitted around the secondary pipe for a portion equal to at least 30% of the length of the secondary pipe.

8. Muffler for motor vehicles according to claim 2, wherein said interspace has a through cross-section of the exhaust gases not less than a through cross-section of the secondary pipe, said through cross-section of the interspace and the through cross-section of the secondary pipe being measured perpendicular to a main longitudinal direction of the secondary pipe itself.

9. Muffler for motor vehicles according to claim 2, wherein said separator septum supports at least partly the containment tube.

10. Muffler for motor vehicles according to claim 1, wherein the throttle valve comprises a partition that opens in the opposite direction to the flow of gas coming from the intake pipe, and comprises a stop ledge which realizes an undercut to the direction of the flow of the exhaust gases, in a closed configuration of the partition.

11. Muffler for motor vehicles according to claim 10, wherein said partition is hinged at a hinge point fixed to the main pipe.

12. Muffler for motor vehicles according to claim 10, wherein the main pipe, at said partition, comprises a housing seat of said partition in an open configuration of the partition.

13. Muffler for motor vehicles according to claim 10, wherein the partition is operatively connected to motor means for the transition of the partition from an open to the closed configuration.

14. Muffler for motor vehicles according to claim 10, wherein said partition comprises a concavity facing in the direction of the exhaust gases coming from the intake pipe.

* * * * *